United States Patent [19]

Cronin

[11] Patent Number: 4,469,988

[45] Date of Patent: Sep. 4, 1984

[54] ELECTRONIC BALLAST HAVING EMITTER COUPLED TRANSISTORS AND BIAS CIRCUIT BETWEEN SECONDARY WINDING AND THE EMITTERS

[76] Inventor: Donald L. Cronin, 1409 James Way, Anaheim, Calif. 92801

[21] Appl. No.: 161,759

[22] Filed: Jun. 23, 1980

[51] Int. Cl.[3] ..... H05B 37/02; H05B 39/04; H05B 41/36

[52] U.S. Cl. ..... 315/209 R; 315/DIG. 5; 315/DIG. 2; 315/205; 315/185 R; 331/113 A

[58] Field of Search ..... 315/DIG. 7, DIG. 5, 315/205, 209, DIG. 2, 232, 185; 331/113 A

[56] References Cited

U.S. PATENT DOCUMENTS

| | | | |
|---|---|---|---|
| 3,691,450 | 9/1972 | Cox | 315/DIG. 7 |
| 3,769,545 | 10/1973 | Crane | 315/DIG. 5 |
| 4,045,711 | 8/1977 | Pitel | 315/DIG. 5 |
| 4,075,476 | 2/1978 | Pitel | 315/DIG. 5 |
| 4,117,377 | 9/1978 | Jimerson et al. | 315/DIG. 5 |
| 4,237,403 | 12/1980 | Davis | 315/DIG. 5 |
| 4,245,177 | 1/1981 | Schmitz | 315/DIG. 5 |
| 4,277,726 | 7/1981 | Burke | 315/DIG. 7 |
| 4,277,728 | 7/1981 | Stevens | 315/DIG. 5 |
| 4,339,690 | 7/1982 | Regan et al. | 315/DIG. 5 |

*Primary Examiner*—Saxfield Chatmon

[57] ABSTRACT

An electronic ballast for energizing fluorescent lamps comprising a converter including a rectifier and a filter for converting an alternating source voltage into a direct current voltage, a network including first and second switching transistors, a tank circuit having a primary winding of a transformer, a secondary winding of the transformer for providing feedback of a portion of the voltage developed across the tank circuits and a bias circuit coupled between the opposite ends of the secondary winding and the emitters of the transistor for alternatively applying bias to the transistors, the network serving to convert a direct current voltage into an amplified sinusoidal voltage having a high frequency, and fluorescent lamps connected in a series configuration coupled across the primary winding.

7 Claims, 1 Drawing Figure

ELECTRONIC BALLAST HAVING EMITTER COUPLED TRANSISTORS AND BIAS CIRCUIT BETWEEN SECONDARY WINDING AND THE EMITTERS

BACKGROUND OF THE INVENTION

1. Field of the Invention

The present invention relates generally to a ballast for energizing fluorescent lamps, and more particularly to an improved electronic ballast for use in energizing fluorescent lamps.

2. Description of the Prior Art

Ballasts for energizing fluorescent lamps are commercially of the type that employ a transformer having primary and secondary windings wound around a common magnetic core. Although simple in construction, the conventional ballast which operates at 60 or 120 Hz may be audibly noisy and generates voltage spikes on the leading edge of each positive and negative alternation. This disadvantageously results in the production of relatively large quantitites of electrical noise. Another disadvantage is that the ballast is heavy and because of core losses is not as energy efficient as desired, and may be subject to heating problems.

Furthermore, it should be noted that the fluorescent tubes energized by the ballast have been connected in a parallel circuit. This consequently requires relatively large quantities of current to turn the lamps on and is plagued by the presence of circulating currents which results in additional power loss and inefficiency.

SUMMARY OF THE PRESENT INVENTION

It is therefore an object of the present invention to provide a ballast for energizing fluorescent lamps which is lightweight, small, operable at a low cost, and is capable of operating the lamps without flicker.

Another object of the present invention is to provide a ballast which utilizes less power, and hence is more energy efficient, than conventional ballasts.

Still another object is to provide an electronic ballast which is capable of selectively dimming the intensity of the light produced by the fluorescent lamps.

Briefly, the preferred embodiment of the present invention comprises a rectifier and a filter for converting an alternating source voltage into a substantially direct current voltage, a network including first and second switching transistors, each having a collector, a base and an emitter with the emitters being coupled together, a tank circuit having a primary winding of a transformer connected to the collectors, the tank circuit being resonant at a high frequency above frequencies that are detectable by humans and below interfering frequencies associated wth amplitude modulated radio stations, a secondary winding of the transformer having its opposite ends connected to the bases and being inductively coupled to the primary winding, the secondary winding serving to feedback a portion of the voltage developed across the tank circuit, and a bias circuit coupled between the opposite ends of the secondary winding and the emitters of the transistors, the seondary winding and bias circuit serving to alternatively bias the base-emitter junction of the first and second transistors with a substantial portion of the feedback voltage developed across the secondary winding, whereby when direct current voltage is connected across the base and the emitter of the first transistor, the network develops an amplified sinusoidal voltage across the primary winding, and at least two fluorescent lamps connected in a series configuration, such configuration requiring a generally lower current from the network and avoiding power loss due to circulating currents to energize the lamps.

An advantage of the present invention is that it is lightweight, small, operable at a relatively low cost and is not subject to flickering.

Another advantage of the present invention is that it requires less power and hence results in substantial savings of energy relative to conventional ballasts.

Still another advantage of the present invention is that it enables fluorescent lamps to be dimmed to a predetermined level so that the intensity of the light produced by the lamps can be controlled to suit the user.

Other objects and advantages of the present invention will no doubt become apparent to those skilled in the art after having read the following detailed description of the preferred embodiment which is illustrated in the figure of the drawing.

IN THE DRAWING

FIG. 1 is a schematic diagram of an electronic ballast in accordance with the present invention.

DETAILED DESCRIPTION OF THE PREFERRED EMBODIMENT

Figure 1:
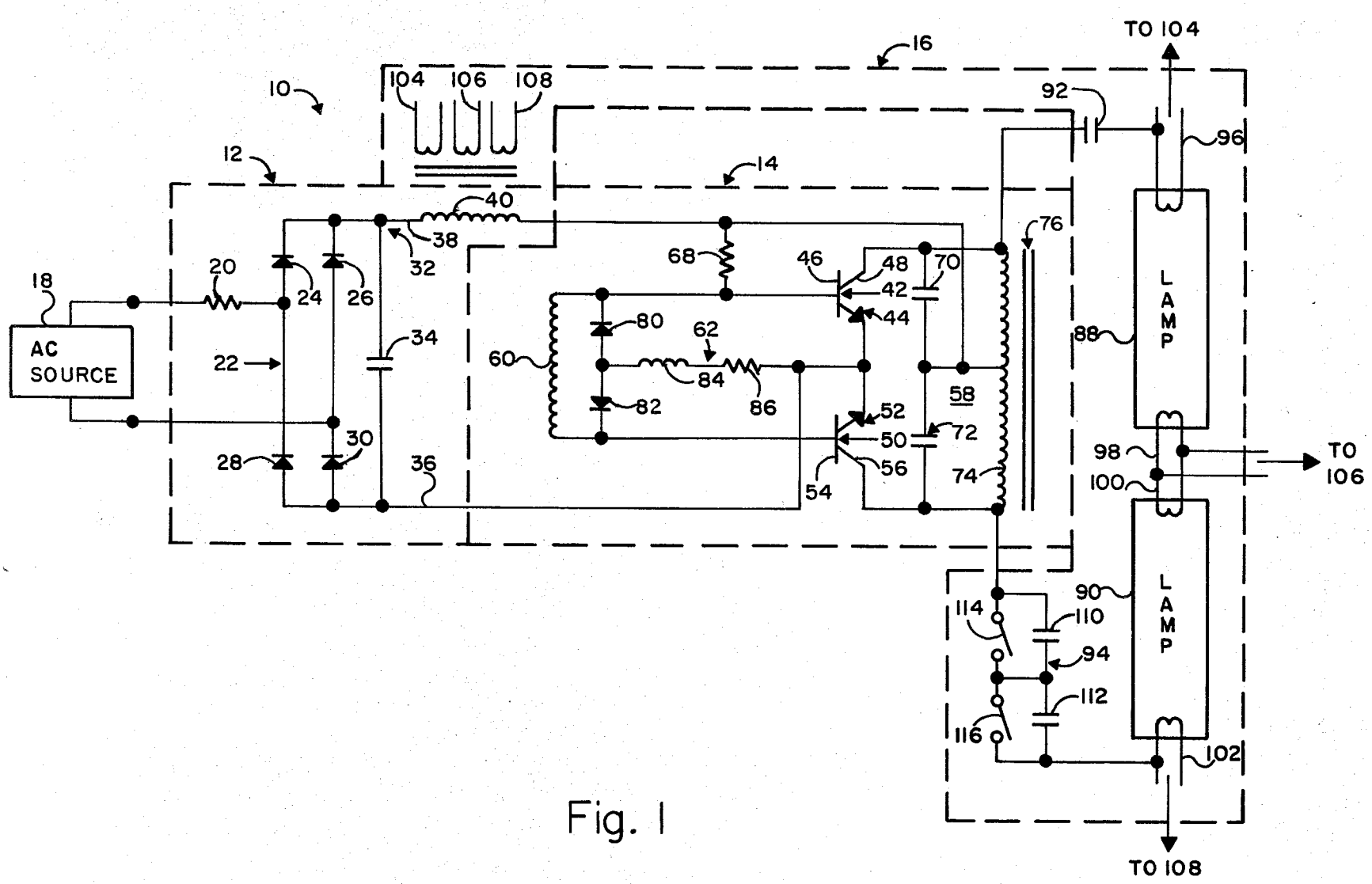

Referring to FIG. 1 of the drawing, an electronic ballast 10 is shown in schematic form in accordance with the present invention. The electronic ballast 10 comprises a first means for converting an alternating source voltage into a substantially direct current voltage 12, a second means for converting a direct current voltage into an amplified sinusoidal voltage 14 and a fluorescent lamp circuit 16. A voltage source 18 is connected to the input of the first means 12 and serves to provide an alternating current voltage to the ballast 10. In the United States the source is that commercially available at wall plugs or the like and serves to provide 120 volts at a frequency of 60 Hertz (Hz), although other frequencies can be used.

The first means for converting 12 includes an input resistor 20 for limiting the input current, a rectifier 22 comprising diodes 24, 26, 28 and 30 arranged in a bridge circuit and configured to provide a full-wave rectified output voltage, and a filter 32 comprising a capacitor 34 between the lines 36 and 38 and an inductor 40 connected to one end of the capacitor 34. The capacitor 34 serves to smooth the rectified voltage developed on the line 38 and the inductor 40 serves to smooth the current by storing energy during one of the supply-voltage cycles and delivering it to the second means 14 during the other part. The rectifier 22 and filter 32 serve to rectify and filter 120 volt, 60 Hz voltage applied from the source 18 and develop a substantially ripple-free direct current voltage of about 150 volts dc at the output of the inductor 40.

In the preferred embodiment, the resistor 42 has a resistance of 2 ohms and a 3 watt power rating. The diodes 24, 26, 28 and 30 are identical, have ratings of 1.5 amperes and 400 volts peak inverse voltage, and are designated as model PF40 by the EDI Corporation of Yonkers, N.Y. The filter capacitor 34 is 80 microfarods with a voltage rating of 175 volts and is preferably one manufactured by Sprague Corporation and identified as Model TVA-1430. The smoothing inductor 40 is formed from 100 turns of No. 24 wire and has a measured inductance of 4 millihenrys at 1.5 amperes.

The means or network for converting a direct current voltage into an amplified sinusoidal voltage 14 includes a power transistor 42 having an emitter 44, a base 46 and a collector 48, a power transistor 50 having an emitter 52, a base 54 and a collector 56, a tank or resonant circuit 58, a secondary winding 60 and a bias circuit 62.

As illustrated, the transistors are of the NPN type with the emitters 44 and 52 being connected together and coupled to the line 36. A current limiting resistor 68 is coupled between the output of the inductor 40 and the base 46 of transistor 42 and one end of the secondary winding 60. The resistor 68 serves to limit the current flowing to the base 46. The transistors 42 and 50 are rendered conducting when their base-emitter junctions are forward biased and rendered non conducting when the junctions are reverse biased. The transistors serve to supply current to the tank circuit 58. The tank circuit 58 includes capacitors 70 and 72, which are connected in series, and a primary winding 74 of a transformer 76. The opposed ends of the winding 74, and of capacitors 70 and 72 are connected to the collectors 48 and 56, respectively. The tank circuit 58 is selected to be resonant at a frequency of about 25,000 Hz, a frequency that is greater than that audible to the ear of a human and less than the frequencies associated with noise emanating from the ever-present amplitude modulated (AM) radio stations. The common point of the capacitors 70 and 72 is connected to the center tap of the winding 74 and to the output of the filter inductor 40. The tank circuit 58 serves to develop an amplified sinusoidal signal of about 450 volts peak-to-peak upon the alternate conduction of the transistors 42 and 50. The winding 60 is wound on a common core with, and hence comprises the secondary of the step-down transformer 76 and is connected at its extremities to the bases 46 and 54 of the transistors 42 and 50. The winding 60 is inductively coupled to the winding 74 and serves to feedback a portion of the alternating current voltage in accordance with the step-down turns ratio, developed by the tank circuit alternatively to the bases 46 and 54 depending upon the polarity of the voltage developed across the winding.

The bias circuit 62 comprises blocking diodes 80 and 82, having their cathodes connected to the opposed ends of winding 60 and their anodes connected together, an inductive choke 84 having one end connected to the anodes of the diodes 80 and 82 and having its opposed end connected through a current limiting resistor 86 to the emitters 44 and 52 and to the line 36. The diodes 80 and 82 serve to selectively conduct corresponding polarities of the alternating voltage developed by the winding 60 to appropriately bias the emitters 44 and 52 and the bases 46 and 54. The choke 84 serves to oppose a change in current therethrough and hence, develop a generally pulse shaped voltage for application to drive the bases.

In operation, when a direct current voltage is applied through resistor 68 to the base 46 and to the tank circuit 58 with the emitter 44 being connected to a lower potential via conductor 36, the power transistor 42 is forward biased and hence rendered conducting. Consequently through tank circuit action a ringing voltage having an amplified and sinusoidal waveform is developed across capacitors 70 and 72. The same sinusoidal voltage which is also developed across the primary winding 74 is transformed through a step-down ratio to the secondary winding 60 in a feedback manner. As will be seen, when a positive voltage is developed at the top end of winding 60, as illustrated in FIG. 1, such voltage is applied directly to the base 46 of transistor 42 which holds the transistor in a conducting state. The diode 80 serves to prevent the passage of this positive voltage to the emitter 44 which is biased by the voltage appearing on line 36. In this case the negative voltage appearing at the other end of winding 60 is conducted to the base 54, thereby maintaining the transistor 50 in a nonconducting state. As the voltage across winding 74, and hence winding 60, swings through zero and reverses, the negative voltage appearing at the top of winding 60 is conducted to the base 46, thereby reverse biasing the base-emitter junction and hence switching transistor 42 off. Substantially simultaneously the base-emitter voltage of transistor 50 becomes forward biased, thereby switching transistor 50 on and completing the cycle with the inductor 84 supplying base drive current. Accordingly, the network 14 converts the direct voltage of 150 watts dc into an amplified oscillating voltage of about 450 volts peak-to-peak at a frequency of about 25 KHz. Since the tank circuit develops a single fundamental frequency, its output is substantially noise free.

In addition, since the winding 60 is not center tapped, substantially the entire voltage developed across it, with the exception of the small voltage drop associated with the inductor 84 and the resistor 86 is developed across the base-emitter junction of the power transistors. This higher voltage results in relatively short collector dwell times and dramatically improves the switching performance of the transistors. For comparison purposes it should be recognized that when transistors are connected in a push-pull configuration, the voltage available to develop the base-emitter voltage is reduced by about 50%. This results in a much longer collector dwell time, reduced switching performance and less efficient operation due to increased power loss through the bias circuit.

In the preferred embodiment of the network, resistor 68 has a resistance of 47 K ohms. The transistors 42 and 44 are identical, having ratings of 1500 volts and 2.5 amps, are manufactured by the Motorola Corporation and designated by them as Model MJ12002, and are of the kind commonly used in horizontal deflection circuits in many television sets. The diodes 80 and 82 are commonly designated as Model 1N4002 and available from many manufacturers. Resistor 86 has a resistance of 5.6 ohms. Capacitors 70 and 72 have a capacitance of 0.01 microfarads. Primary winding 74 has 60 turns on each side of its center tap and has an inductance of 5 millihenrys at one ampere. Secondary winding 60 is formed by one turn and develops about 6 volts when 450 volts peak-to-peak are developed across winding 74.

In an alternative configuration, the inductance 84 can be formed as a winding on the inductance 40 and the resistor 86 eliminated.

The fluorescent lamp circuit 16 includes conventional fluorescent lamps 88 and 90 connected in a series configuration, an isolation capacitor 92, and a current limiting circuit 94. The lamp 88 includes heater elements or filaments 96 and 98. Similarly the lamp 90 includes heater elements or filaments 100 and 102 with the filaments 98 and 100 being coupled together. The heater elements 96, 98 and 102 are inductively coupled to secondary windings 104, 106 and 108, respectively, which form the secondary of the filter inductor 40. The resistance associated with the heater elements 96, 98, 100 and 102 serve to damp the inductor 40 and hence limit the transient voltage overshoot when the lamps are turned off. Since the inductor 40 has a greater number of turns than the secondary winding 60, a better resolution of the voltage is capable of being supplied to the filaments. This serves to extend lamp life, conserve electrical power and eliminate the need for a separate transformer to couple the voltage from the secondary winding 60 to the heater elements. The capacitor 92 has a value of capacitance which creates a relatively high reactance at the frequency of the alternating source voltage 18. This serves to isolate the lamps and the network input portion 14 of the ballast. Consequently the input portion is not subjected to electrical stress in the form of high transient voltages of currents which could arise should a lamp be inadvertently connected to ground during operation or during the removal of a lamp.

In comparison with conventional parallel fluorescent lamp configurations, the series connection of the lamps precludes the development of circulating currents. This reduces power loss in the lamp circuit while improving efficiency and enables lower-cost inductor and capacitor components to be used.

The current-limiting circuit 94, as illustrated, includes a pair of serially connected capacitors 110 and 112 which are connected between one end of the winding 74 and the lamp 90. Switches 114 and 116 are connected across the respective capacitors 110 and 112. The current-limiting circuit 94 enables a selected reactance to be placed in series with the lamps, thereby serving to reduce the current flowing in the fluorescent lamp circuit to a predetermined quantity. For example, if switch 114 is closed, only the capacitor 112 remains in the lamp circuit. This capacitive arrangement enables the current flowing through the lamps to be adjustable, whereby the intensity of the light produced by the lamps is capable of being varied, and hence controlled. By selectively adjusting the switches 114 and 116 the lamps may be dimmed to provide lighting suitable to the user. The reduction in current flowing through the lamps has a positive effect on lamp life without causing lamp cathode degradation. It should be noted that if both switches 114 and 116 are closed, the lamp current is at normal rating.

Although only a two stage capacitive network is illustrated in the current limiting circuit 94, it should be recognized that additional capacitive stages could be included to allow further control of the light intensity produced by the lamps. Alternatively, a second isolation capacitor (not shown) can be employed between the lamp 90 and the circuit 94 to isolate the lamps and the network 14 from transients. In the preferred embodiment, the isolation capacitors are identical, have a 0.0082 microfarod capacitance, a 715 volt peak voltage and are manufactured by Sprague Corporation.

In operation of the ballast when a 120 volt alternating current signal is applied to the converter stage 12 a direct voltage of about 150 volts is produced at the output of the inductor 40. The application of this voltage to the network 14 causes an oscillating sinusoidal voltage of about 450 volts peak to peak to be developed across the primary winding 76, which in turn energizes the fluorescent lamps 88 and 90. The use of a tank circuit resonant at 25 KHz increases the light intensity produced by the fluorescent lamp by about 17% over that produced from a lamp energized by voltage having a frequency of about 120 cycles per second. Since the tank circuit develops only a fundamental frequency of 25 KHz radio frequency or electromagnetic interference in the ballast is generally eliminated.

From the above, it will be seen that there has been provided an electronic ballast for energizing fluorescent lamps which fulfills all of the objects and advantages set forth above.

While the invention has been particularly shown and described with reference to certain preferred embodiments, it will be understood by those skilled in the art that various alterations and modifications in form and detail may be made therein without departing from the invention. Accordingly, it is intended that the following claims cover all such alterations and modifications as fall within the true and scope of the invention.

What is claimed is:

1. An electrical ballast for energizing fluorescent lamps comprising:

first means for converting an alternating source voltage into a substantially direct current voltage;

second means for converting a direct current voltage into an amplified sinusoidal voltage having a relatively high frequency that is generally inaudible to humans, said second means including first and second power transistors, each having a collector, a base and an emitter, said emitters being coupled together;

a tank circuit including a primary winding of a transformer connected to said collectors, said tank circuit being resonant at said relatively high frequency;

a secondary winding of the transformer having its opposite ends connected to said bases and being inductively coupled to said primary winding, said secondary winding serving to feed back a portion of the voltage developed by said tank circuit; and bias circuit means coupled between the opposite ends of the secondary winding and said emitters, said secondary winding and said bias circuit means serving to alternatively bias the base-emitter junction of said first and second transistors with a substantial portion of the feedback voltage developed across said secondary winding, whereby when said direct current voltage is connected across said base and said emitter of said first transistor, said amplified sinusoidal voltage is developed across said primary winding;

at least two fluorescent lamps connected in a series configuration across said primary winding; and capacitive means having a relatively high capacitive reactance at the frequency of the alternating source voltage for isolating said fluorescent lamps from said second means for converting such that should said lamps be inadvertently connected to ground, electrical stress will not be transmitted to said second means for converting.

2. An electronic ballast as recited in claim 1 and further including capacitive means for selectively changing the current flowing through said lamps whereby the intensity of the light produced by said lamps is capable of being adjusted.

3. An electronic ballast as recited in claim 1 wherein said lamps include a heater element means and wherein said first means includes an inductive means, said heater element means being inductively coupled to said inductive means and serving to load said inductive means so as to limit transient voltages from being coupled to said first means.

4. An electrical ballast as recited in claim 1 wherein said bias circuit means includes a pair of blocking diodes having their cathodes connected to the opposed ends of said secondary winding and their anodes connected together, and an inductor having one end connected to the anodes and having its other end coupled to said emitters, said bias circuit serving to drive said bases with a generally pulse shaped voltage.

5. An electrical ballast for energizing fluorescent lamps comprising:

first means for converting an alternating source voltage into a substantially direct current voltage; and second means for converting a direct current voltage into an amplified sinusoidal voltage having a relatively high frequency that is generally inaudible to humans, said second means including first and second power transistors, each having a collector, a base and an emitter, said emitters being coupled together;

a tank circuit including a primary winding of a transformer connected to said collectors, said tank circuit being resonant at said relatively high frequency;

a secondary winding of the transformer having its opposite ends connected to said bases and being inductively coupled to said primary winding, said secondary winding serving to feed back a position of the voltages developed by said tank circuit; and bias circuit means including a pair of blocking diodes having their cathodes connected to the opposed ends of said secondary winding and their anodes connected together, and an inductor having one end connected to the anodes and having its other end coupled to said emitters, said bias circuit serving to drive said bases with a generally pulse shaped voltage, said secondary winding and said bias circuit means serving to alternatively bias the base-emitter junctions of said first and second transistors with a substantial portion of the feedback voltage developed across said secondary winding, whereby when said direct current voltage is connected across said base and said emitter of said first transistor, said amplified sinusoidal voltage is developed across said primary winding and applied to energize the fluorescent lamps.

6. An electronic ballast as recited in claim 5 and further including fluorescent lamps connected to said primary winding and capacitive means for selectively changing the current flowing through the fluorescent lamps whereby the intensity of the light produced by said lamps is capable of being adjusted.

7. An electronic ballast as recited in claim 5 and further including fluorescent lamps having a heater element, and wherein said first means includes an inductive means, said heater element being inductively coupled to said inductive means and serving to load said inductive means so as to limit transient voltages from being coupled to said first means.

* * * * *